US009484174B2

(12) United States Patent
Matsumura et al.

(10) Patent No.: US 9,484,174 B2
(45) Date of Patent: Nov. 1, 2016

(54) FUSE UNIT

(71) Applicant: YAZAKI CORPORATION, Minato-ku, Tokyo (JP)

(72) Inventors: Norio Matsumura, Shizuoka (JP); Hidenori Kibushi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 248 days.

(21) Appl. No.: 14/010,678

(22) Filed: Aug. 27, 2013

(65) Prior Publication Data

US 2013/0342304 A1 Dec. 26, 2013

Related U.S. Application Data

(63) Continuation of application No. PCT/JP2012/001199, filed on Feb. 22, 2012.

(30) Foreign Application Priority Data

Mar. 10, 2011 (JP) ..... 2011-052767

(51) Int. Cl.
*H01H 85/044* (2006.01)
*H01H 85/175* (2006.01)
(Continued)

(52) U.S. Cl.
CPC ..... *H01H 85/00* (2013.01); *H01H 85/044* (2013.01); *H01H 85/175* (2013.01); *H01H 85/2045* (2013.01); *H01R 11/287* (2013.01); *H01H 2085/025* (2013.01); *H01H 2085/0555* (2013.01)

(58) Field of Classification Search
CPC .. H01H 85/044; H01H 85/143; H01H 69/02; H01H 85/08; H01H 2085/266; H01H 85/175; H01H 85/47; H01H 2085/0555; H01H 85/2045; H01H 85/00; H01H 2085/025; H01R 11/287
USPC ..... 337/142, 159, 187, 227, 290, 296; 29/623
See application file for complete search history.

(56) References Cited

U.S. PATENT DOCUMENTS 5,886,611 A * 3/1999 Schaller ..... H01H 85/044 337/187
6,294,978 B1 * 9/2001 Endo ..... H01H 85/044 337/159

(Continued)

FOREIGN PATENT DOCUMENTS

CN 102741963 A 10/2012
DE 102009034040 A1 2/2010

(Continued)

OTHER PUBLICATIONS

JPOA letter issued on Nov. 4, 2014.

(Continued)

*Primary Examiner* — Anatoly Vortman
(74) *Attorney, Agent, or Firm* — Mots Law, PLLC

(57) ABSTRACT

A fuse unit includes a bus bar and an insulating protection portion. The bus bar has a power supply connection portion, an output connection portion, and a terminal installation recess provided around the power supply connection portion. The insulating protection portion is disposed on an outer surface of the bus bar so that portions of a surface of the bus bar in the power supply connection portion, the output connection portion, and the terminal installation recess are exposed from the insulating protection portion.

16 Claims, 6 Drawing Sheets

(51) Int. Cl.

| | |
|---|---|
| ***H01H 85/00*** | (2006.01) |
| ***H01H 85/20*** | (2006.01) |
| ***H01R 11/28*** | (2006.01) |
| *H01H 85/02* | (2006.01) |
| *H01H 85/055* | (2006.01) |

(56) References Cited

U.S. PATENT DOCUMENTS

| | | | | |
|---|---|---|---|---|
| 6,509,824 | B2 * | 1/2003 | Inaba | H01H 85/044 29/623 |
| 6,512,443 | B1 * | 1/2003 | Matsumura | H01H 85/044 337/161 |
| 6,558,198 | B2 * | 5/2003 | Kobayashi | H01H 85/0417 337/290 |
| 6,576,838 | B2 * | 6/2003 | Matsumura | H01H 85/044 174/135 |
| D560,172 | S * | 1/2008 | Ohta | H01H 85/044 D13/161 |
| 7,568,921 | B2 * | 8/2009 | Pavlovic | H01H 85/0417 439/620.26 |
| 7,663,465 | B2 * | 2/2010 | Matsumoto | H01H 85/044 337/187 |
| 2001/0011939 | A1 | 8/2001 | Inaba et al. | |
| 2002/0134572 | A1 | 9/2002 | Matsumura | |
| 2002/0163416 | A1 | 11/2002 | Matsumura | |
| 2005/0285709 | A1 | 12/2005 | Matsumura et al. | |

FOREIGN PATENT DOCUMENTS

| | | | |
|---|---|---|---|
| EP | 1124246 | A2 | 8/2001 |
| EP | 1239506 | A2 | 9/2002 |
| EP | 1548785 | A1 | 6/2005 |
| JP | H11-329205 | A | 11/1999 |
| JP | 2001-297683 | A | 10/2001 |
| JP | 2002-270082 | A | 9/2002 |
| JP | 2005-190735 | A | 7/2005 |
| JP | 2009-110843 | A | 5/2009 |
| JP | 2009-283367 | A | 12/2009 |
| JP | 2010-040254 | A | 2/2010 |
| JP | 2010-73516 | A | 4/2010 |
| JP | 2010-129313 | A | 6/2010 |
| JP | 2010-277985 | A | 12/2010 |
| WO | 2011/096451 | A1 | 8/2011 |
| WO | 2011/096496 | A1 | 8/2011 |

OTHER PUBLICATIONS

KROA letter issued on Sep. 18, 2014.
Chinese office action letter issued on Feb. 6, 2015 in the counterpart Chinese application.
Chinese office action letter issued on Aug. 7, 2015 in the counterpart Chinese application.
Chinese office action issued on Jan. 19, 2016 in the counterpart Chinese patent application.

* cited by examiner

FUSE UNIT

CROSS REFERENCE TO RELATED APPLICATION

This application is a Continuation of PCT Application No. PCT/JP2012/001199, filed on Feb. 22, 2012, and claims the priority of Japanese Patent Application No. 2011-052767, filed on Mar. 10, 2011, the content of both of which is incorporated herein by reference.

BACKGROUND

1. Technical Field

The present invention relates to a fuse unit.

2. Related Art

Various fuse units of a type in which the fuse unit is directly connected to a battery have been conventionally proposed (see Patent Literature 1 and Patent Literature 2). An example of such type of fuse unit is shown in FIG. 1.

In FIG. 1, a fuse unit 100 is fixed to a battery post (not illustrated) of a battery (not illustrated) via a battery terminal 130. The fuse unit 100 includes a bus bar 110 being a conductive metal plate and an insulating protection portion 120 provided on an outer surface of the bus bar 110 by insert resin molding.

The bus bar 110 has: a power supply connection portion 111 to which the battery terminal 130 is connected and to which the power is supplied from the battery post (not illustrated); multiple output connection portions 112 (not all are illustrated) to which load-side terminals are connected; and fuse portions (not illustrated) which are each disposed between the power supply connection portion 111 and a corresponding one of the output connection portions 112 (not all are illustrated).

The insulating protection portion 120 is disposed on the outer periphery of the bus bar 110 except for the portions of the power supply connection portion 111, the output connection portions 112 (not all are illustrated), and the fuse portions (not illustrated). This arrangement aims to achieve an increase in strength of the fuse unit 100, and the like. Moreover, a connector housing 121 for the output connection portions (not illustrated) is formed by the insulating protection portion 120.

In the power supply connection portion 111, the front and back surfaces of the bus bar 110 are not covered with the insulating protection portion 120 and are exposed, including one end surface 110*a* of the bus bar 110. A bolt insertion hole 111*a* is formed in the power supply connection portion 111.

In the power supply connection portion 111, the battery terminal 130 is set to protrude from the exposed one end surface 110*a* of the bus bar 110. Then, the battery terminal 130 thus set and the power supply connection portion 111 are fastened to each other with a nut (not illustrated) and a bolt 130*a* inserted into the bolt insertion hole 111*a*. The battery terminal 130 is connected to the exposed surface of the bus bar 110 while being in tight contact therewith.

CITATION LIST

Patent Literature

[PTL 1] Japanese Unexamined Patent Application Publication No. 2010-73516

[PTL 2] Japanese Unexamined Patent Application Publication No. 2010-277985

SUMMARY

As shown in FIG. 1, there is a case where a connection terminal 131 connected to a wire W is fastened together with the battery terminal 130. In the related art described above, the battery terminal 130 is disposed on a front side of the power supply connection portion 111 while the insulating protection portion 120 (a portion denoted by reference numeral 120*a* in the drawing) is disposed on a rear side of the power supply connection portion 111. Accordingly, only a space below and a space above the power supply connection portion 111 can be used as a space for installing the connection terminal 131 and for leading out the wire W. Because of this restriction, there is no way but to use an L-shaped terminal as the connection terminal 131 and lead out the wire W to the space below the power supply connection portion 111 (shown in solid lines in FIG. 1) or to the space above the power supply connection portion 111 (shown in imaginary lines in FIG. 1). Due to the reason described above, a degree of freedom in installation pattern of the connection terminal 131 and a degree of freedom in lead-out direction of the wire W are small.

An object of the present invention is to provide a fuse unit in which a connection terminal of a wire is connected to a power supply connection portion together with a battery terminal, the fuse unit having a large degree of freedom in installation pattern of the connection terminal and a large degree of freedom in lead-out direction of the wire.

An aspect of the present invention is a fuse unit comprising: a bus bar having a power supply connection portion, an output connection portion, and a terminal installation recess provided around the power supply connection portion; and an insulating protection portion disposed on an outer surface of the bus bar so that portions of a surface of the bus bar in the power supply connection portion, the output connection portion, and the terminal installation recess are exposed from the insulating protection portion.

A width of an exposed portion of the surface of the bus bar in the terminal installation recess may be smaller than a width of an exposed portion of the surface bus bar in the power supply connection portion.

The power supply connection portion may be provided in a portion of the bus bar on one side of a bent portion at which the bus bar is bent, and the terminal installation recess may be provided to extend to a position of the bent portion of the bus bar.

The power supply connection portion and the output connection portion may be connected to each other via a fuse portion.

According to the configuration described above, the connection terminal can be installed by using the terminal installation recess in addition to the space above and the space below the power supply connection portion. Thus, the degree of freedom in the installation pattern of the connection terminal and the degree of freedom in the lead-out direction of the wire are large.

DETAILED DESCRIPTION

An embodiment of the present invention is described below based on the drawings.

Figure 1:
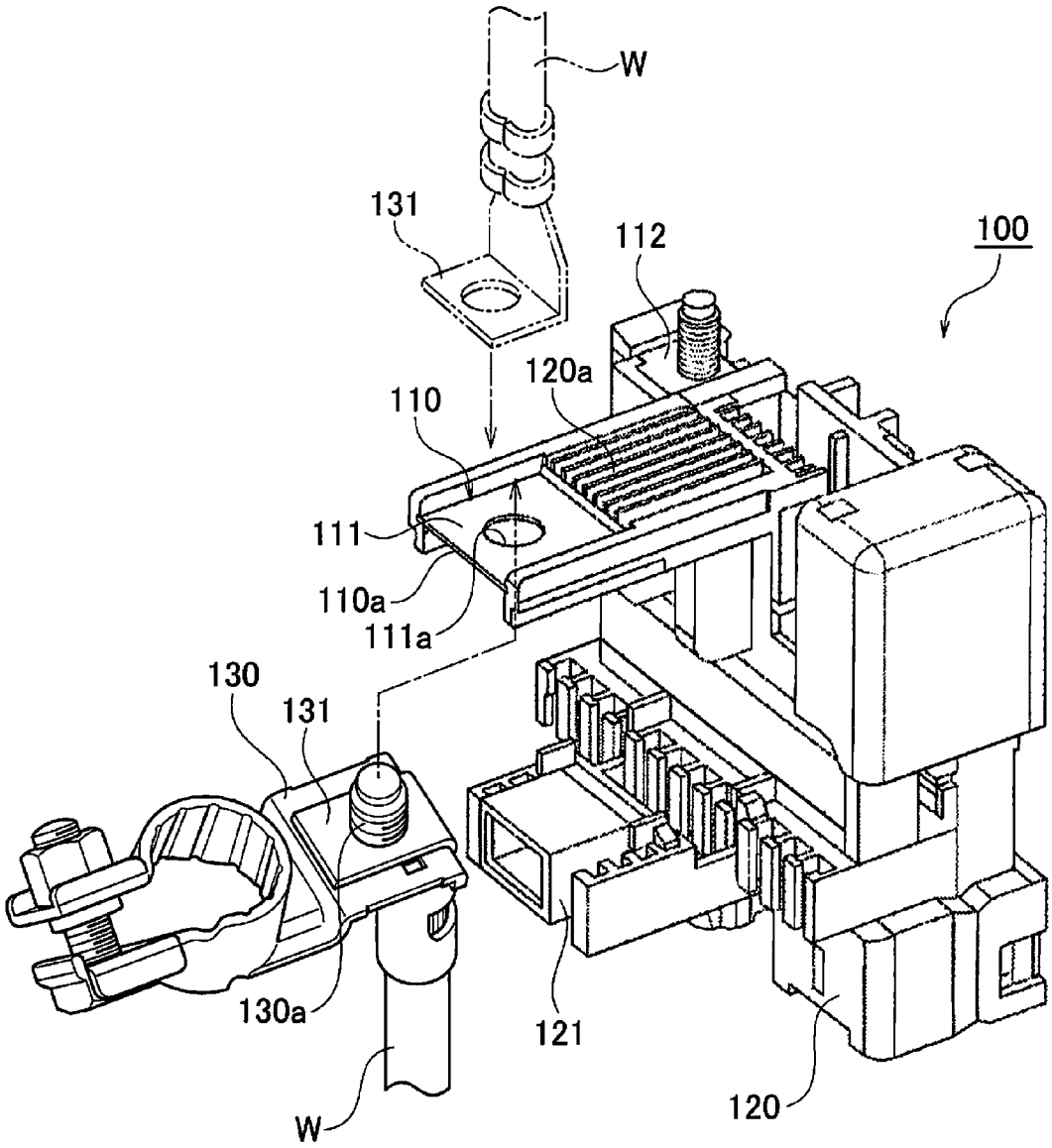
FIG. 1 RELATED ART
FIG. 1 is a perspective view of a fuse unit of a related art.
Figure 2:
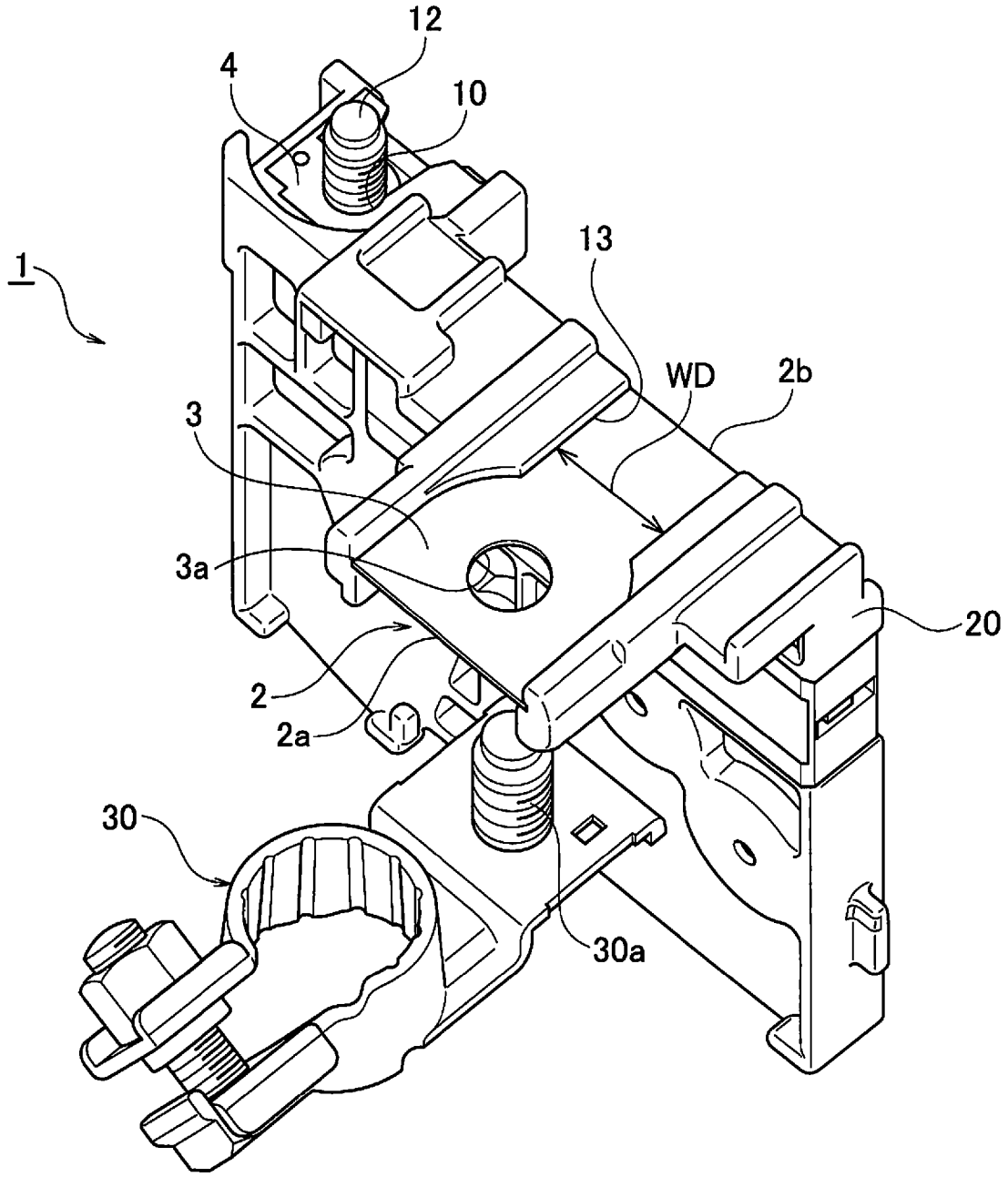
FIG. 2 is a perspective view of a fuse unit of an embodiment of the present invention.

FIGS. 2 to 6 show the embodiment of the present invention. As shown in FIG. 2, a fuse unit 1 includes a bus bar 2 formed from a conductive metal plate to have a predetermined shape and an insulating protection portion 20 disposed on an outer surface of the bus bar 2.

A power supply connection portion 3, a first output connection portion 4, four second output connection portions 5 (shown in FIGS. 4 to 6), and fuse portions (not illustrated) are formed in the bus bar 2. The power supply connection portion 3 is fixed to a battery post (not illustrated) via a battery terminal 30. Each of the fuse portions is disposed between the power supply connection portion 3 and a corresponding one of the first and second output connection portions 4 and 5 and connects the two to each other. The bus bar 2 is bent at right angles at a bent portion 2*b* and is formed to have an L-shape. The power supply connection portion 3 and the first output connection portion 4 are disposed in a portion of the bus bar 2 on one side of the bent portion and the fuse portions (not illustrated) and the second output connection portions 5 are disposed in a portion of the bus bar 2 on the other side of the bent portion.

A bolt insertion hole 3*a* is formed in the power supply connection portion 3. The battery terminal 30 is connected by using the bolt insertion hole 3*a*.

A bolt press-fit groove 10 is formed in the first output connection portion 4. A bolt screw hole 11 is formed in each of the second output connection portions 5. A bolt 12 is inserted into each of the bolt press-fit groove 10 and the bolt screw holes 11. Head portions of the respective bolts 12 are fixed by the insulting protection portion 20. Mating terminals (not illustrated) are fastened and connected respectively to the first output connection portion 4 and the second output connection portions 5 by using the bolts 12.

The insulating protection portion 20 is formed by insert molding with the bus bar 2 and the bolts 12 being inserted parts, the bolts 12 temporarily fixed to the bus bar 2. The insulating protection portion 20 is disposed to basically cover an outer periphery of the bus bar 2 except for portions of the power supply connection portion 3, the first output connection portion 4, the second output connection portions 5, and the fuse portions (not illustrated). In the power supply connection portion 3, the front and back surfaces of the bus bar 2 are not covered with the insulating protection portion 20 and are exposed, including one end surface 2*a* of the bus bar 2. A terminal installation recess 13 is provided in the surrounding of the power supply connection portion 3 by disposing no insulating protection portion 20 and thus exposing the surface of the bus bar 2. An exposure width WD of the bus bar 2 in the terminal installation recess 13 is smaller than that in the power supply connection portion 3 and is set to a width slightly larger than the width of a connection terminal 31C shown in FIG. 6. The terminal installation recess 13 is provided to extend to the position of the bent portion 2*b* of the bus bar 2. The bent portion 2*b* of the bus bar 2 is thereby exposed.

Figure 3:
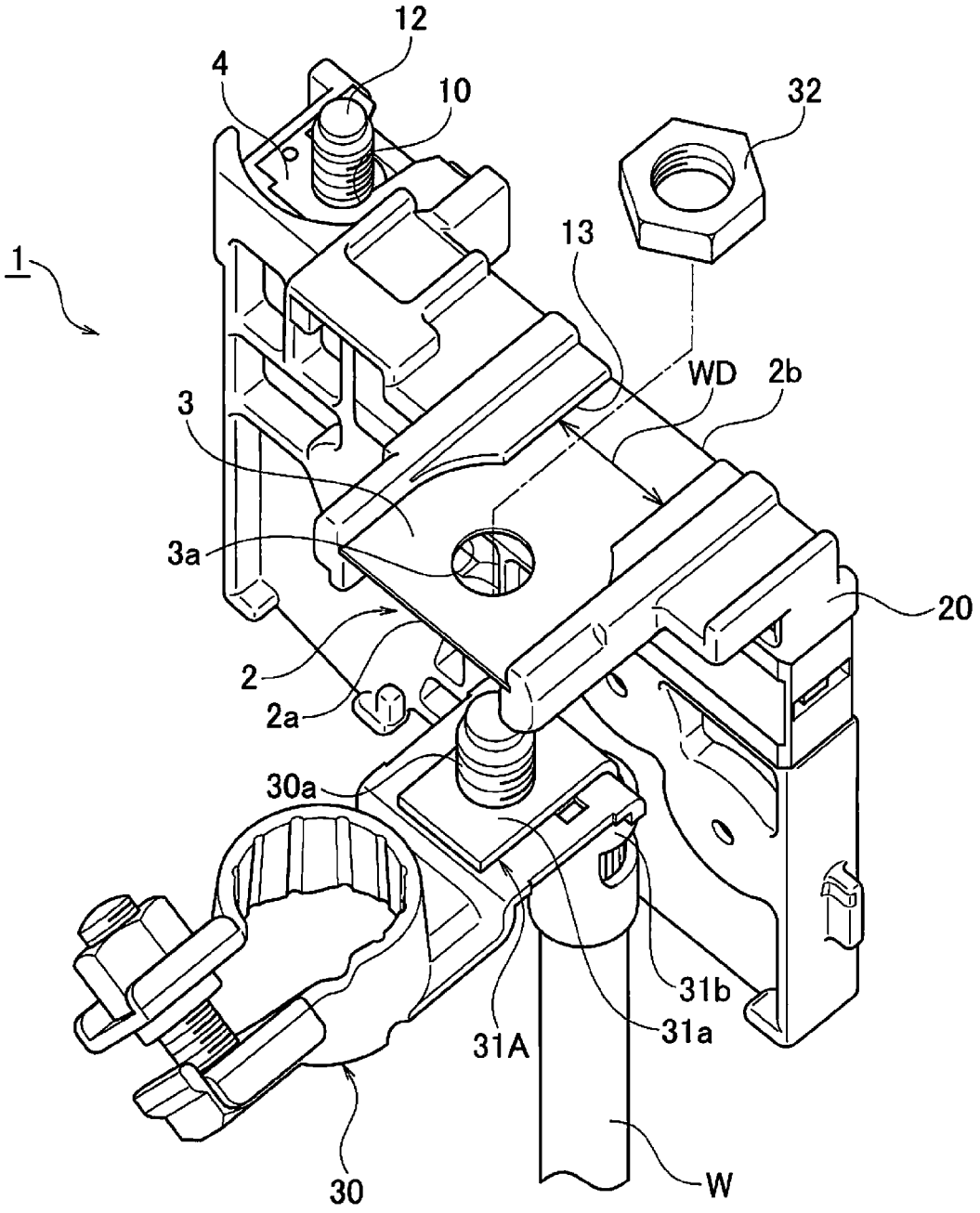
FIG. 3 is a perspective view of the fuse unit of the embodiment of the present invention which shows a configuration of a battery terminal and a connection terminal when a wire is led out downward.

Next, descriptions are given of an installation pattern of connection terminals 31A to 31C to be fastened to the power supply connection portion 3 together with the battery terminal 30. First, descriptions are given of the case where a wire W is installed to be led out toward a space below the power supply connection portion 3. As shown in FIG. 3, a terminal (LA terminal) having such an L-shape form that the terminal is bent substantially at right angles at a portion between a terminal pressure-bonding portion 31*a* and a wire crimp portion 31*b* is used as the connection terminal 31A. The connection terminal 31A has a fixing bolt 30*a* of the battery terminal 30 inserted therein with the wire W led out in a downward direction. Then, the fixing bolt 30*a* is inserted into the bolt insertion hole 3*a* of the power supply connection portion 3. Thereafter, the fixing bolt 30*a* and a nut 32 are fastened to each other. The connection terminal 31A is installed by using the space below the power supply connection portion 3.

Figure 4:
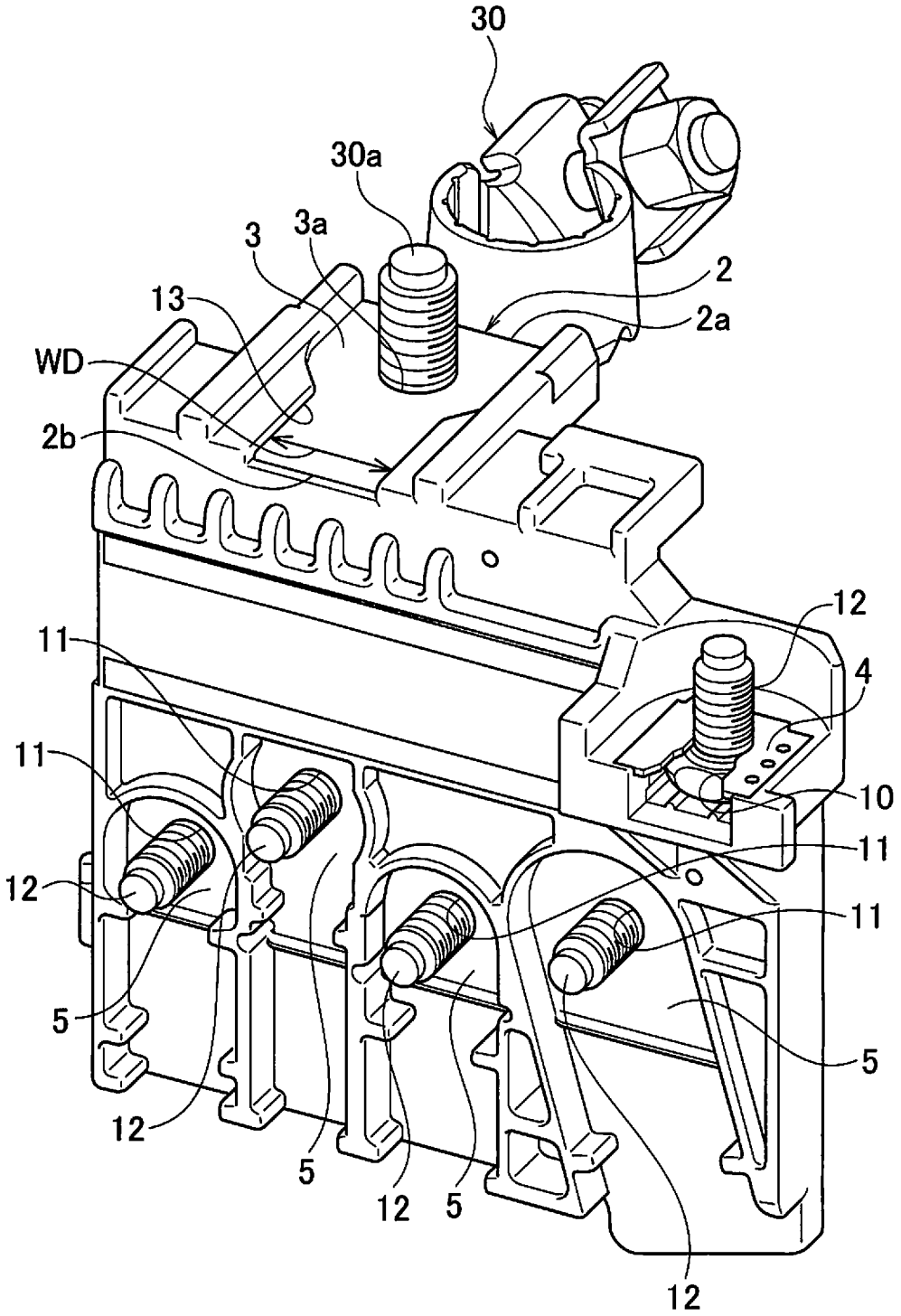
FIG. 4 is a perspective view of the fuse unit of the embodiment of the present invention which shows a configuration of the battery terminal when the wire is led out upward or rearward (away from the battery).
Figure 5:
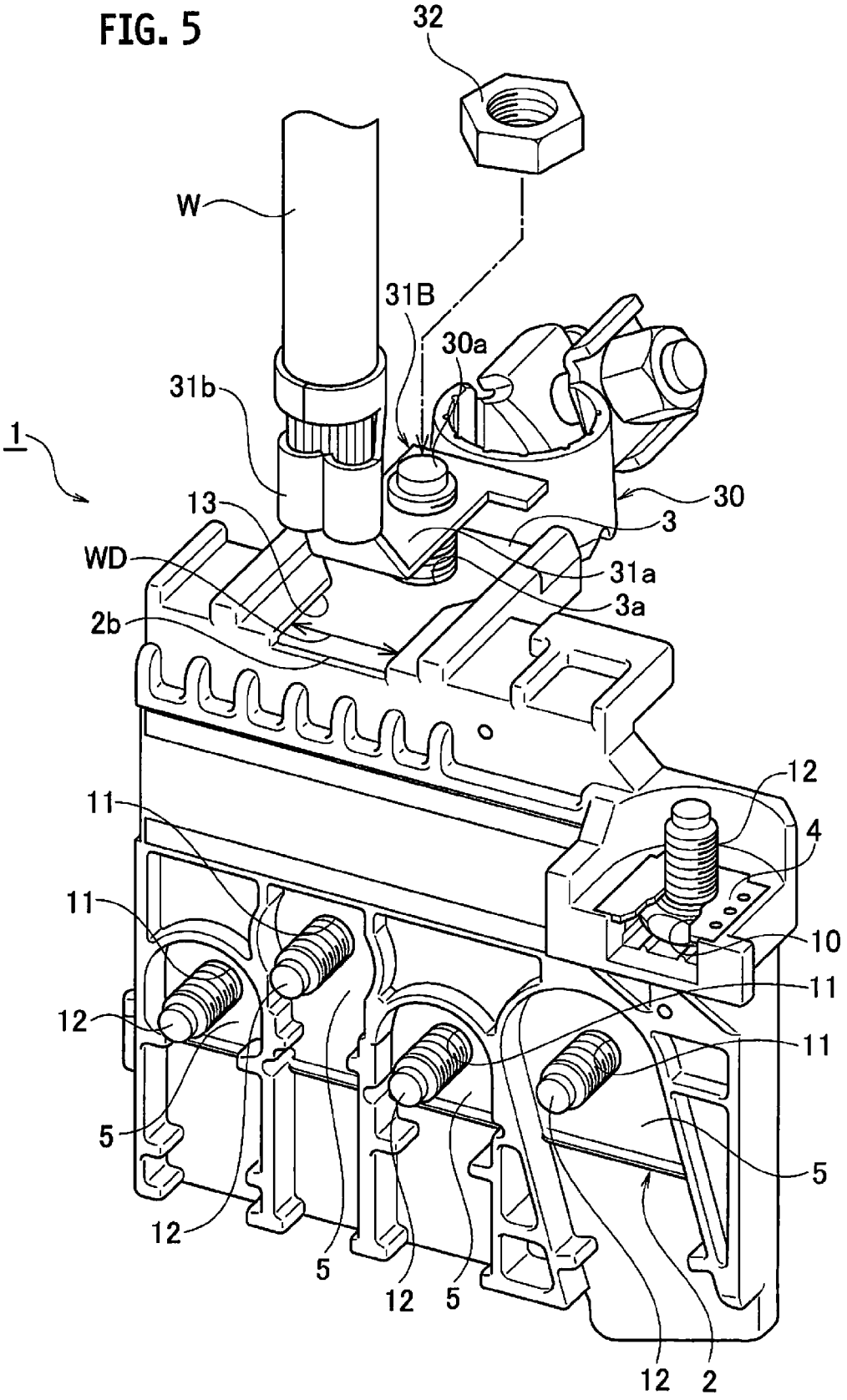
FIG. 5 is a perspective view of the fuse unit of the embodiment of the present invention which shows a configuration of the battery terminal and the connection terminal when the wire is led out upward.

Next, descriptions are given of the case where the wire W is installed to be led out toward a space above the power supply connection portion 3. As shown in FIG. 4, the fixing bolt 30*a* of the battery terminal 30 is inserted into the bolt insertion hole 3*a* of the power supply connection portion 3 from below. Then, as shown in FIG. 5, a terminal (LA terminal) having such an L-shape form that the terminal is bent substantially at right angles at a portion between the terminal pressure-bonding portion 31*a* and the wire crimp portion 31*b* is used as a connection terminal 31B. The connection terminal 31B has the fixing bolt 30*a* of the battery terminal 30 inserted therein with the wire W led out in an upward direction, and the fixing bolt 30*a* and the nut 32 are fastened to each other. The connection terminal 31B is installed by using the space above the power supply connection portion 3. Moreover, a terminal is used as the connection terminal 31B, the terminal having such an L-shape form that the terminal is bent substantially at right angles at the portion between the terminal pressure-bonding portion 31*a* and the wire crimp portion 31*b*, the terminal pressure-bonding portion 31*a* having a long length. Moreover, the wire W can be also led out downward from a rear side (side away from the battery) of the power supply connection portion 3 by disposing the terminal pressure bonding portion 31*a* along the exposed surface of the bus bar 2 in the power supply connection portion 3 and the terminal installation recess 13 and by disposing the wire crimp portion 31*b* downward.

Figure 6:
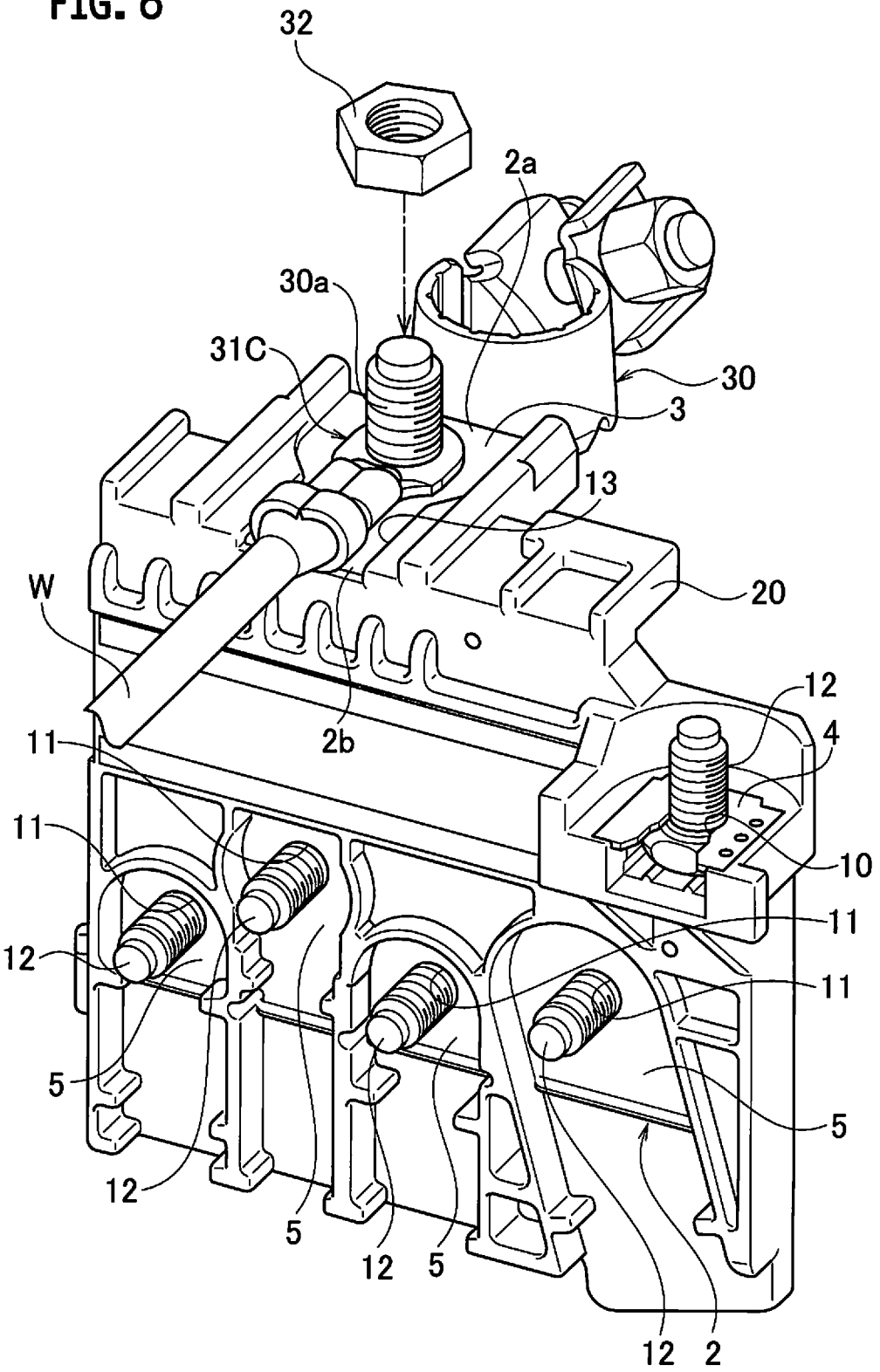
FIG. 6 is a perspective view of the fuse unit of the embodiment of the present invention which shows a configuration of the battery terminal when the wire is led out rearward (away from the battery).

Next, descriptions are given of the case where the wire W is installed to be horizontally led out toward a space rearward (on a side away from the battery) of the power supply connection portion 3. As shown in FIG. 4, the fixing bolt 30*a* of the battery terminal 30 is inserted into the bolt insertion hole 3*a* of the power supply connection portion 3 from below. Then, as shown in FIG. 6, a terminal (LA terminal) having such a straight form that the terminal pressure-bonding portion 31*a* and the wire crimp portion 31*b* are linear is used as the terminal 31C. The connection terminal 31C has the fixing bolt 30*a* of the battery terminal 30 inserted therein with the wire W led out in a direction toward the space rearward (on a side away from the battery) of the power supply connection portion 3. Thereafter, the fixing bolt 30*a* and the nut 32 are fastened to each other. The connection terminal 31C is installed along the exposed surface of the bus bar 2 in the power supply connection portion 3 and the terminal installation recess 13.

As described above, the terminal installation recess 13 is provided in the surrounding of the power supply connection portion 3 by disposing no insulating protection portion 20 and thus exposing the surface of the bus bar 2. Accordingly, the connection terminals 31A to 31C can be installed by using the terminal installation recess 13 in addition to the space above and the space below the power supply connection portion 3. Thus, the degree of freedom in installation pattern of the connection terminals 31A to 31C and the degree of freedom in lead-out direction of the wire W are improved.

The exposure width WD of the bus bar 2 in the terminal installation recess 13 is smaller than that in the power supply connection portion 3. Thus, the terminal installation recess 13 prevents rotation of the connection terminal 31C during the fastening of the bolt 30*a* and the nut 32. Moreover, the exposed area of the bus bar 2 is made as small as possible and the reduction in strength is thereby suppressed.

The power supply connection portion 3 is disposed in a portion of the bus bar 2 on one side of the bent portion 2*b* at which the bus bar 2 is bent and the terminal installation recess 13 is provided to extend to the position of the bent portion 2*b* of the bus bar 2. Accordingly, the wire W can be led out to protrude outward of the bent portion 2*b* of the bus bar 2. Thus, a space on the outer side of the bent portion 2*b* of the bus bar 2 can be effectively used.

The fuse unit 1 has been described above based on the embodiment illustrated in the drawings. However, the invention is not limited to the embodiment and the configuration of parts can be replaced with any configuration having a similar function.

What is claimed is:

1. A fuse unit comprising:

a bus bar having a power supply connection portion, an output connection portion, and a terminal installation recess provided around the power supply connection portion;

an insulating protection portion disposed on an outer surface of the bus bar so that portions of a surface of the bus bar in the power supply connection portion, the output connection portion, and the terminal installation recess are exposed from the insulating protection portion; and a wire installed on the power supply connection portion, wherein the power supply connection portion is provided in a portion of the bus bar on one side of a bent portion at which the bus bar is bent, the terminal installation recess is provided to extend to a position of the bent portion of the bus bar, the power supply connection portion comprises a bolt insertion hole, a connection terminal of the wire comprises an inserted fixing bolt of a battery terminal inserted into the bolt insertion hole of the power supply connection portion, and the connection terminal is connected to the power supply connection portion using the fixing bolt and a fastening nut.

2. The fuse unit according to claim 1, wherein a width of an exposed portion of the surface of the bus bar in the terminal installation recess is smaller than a width of an exposed portion of the surface of the bus bar in the power supply connection portion.

3. The fuse unit according to claim 1, wherein the terminal installation recess is provided to extend the position of the bent portion of the bus bar such that the wire is connected to the power supply connection portion and protrudes outward of the bent portion of the bus bar.

4. The fuse unit according to claim 3, wherein the wire is connected to the power supply connection portion and protrudes outward of the bent portion of the bus bar through a space on the outer side of the bent portion of the bus bar.

5. The fuse unit according to claim 1, wherein the output connection portion comprises:

a first output connection portion; and second output connection portions.

6. The fuse unit according to claim 5, wherein:

the power supply connection portion and the first output connection portion are disposed in the portion of the bus bar on the one side of the bent portion at which the bus bar is bent; and the second output connection portions are disposed in a portion of the bus bar on another side of the bent portion at which the bus bar is bent.

7. The fuse unit according to claim 1, wherein the bent portion of the bus bar comprises an L-shape.

8. The fuse unit according to claim 1, wherein the insulating protection portion is disposed such that an outer periphery of the bus bar except for the power supply connection portion and the output connection portion is covered with the insulating protection portion.

9. The fuse unit according to claim 1, wherein the power supply connection portion comprises a space below such that the wire installed on the power supply connection portion leads out in a downward direction toward the space below, the connection terminal has a bend that is bent substantially at right angles at a portion between a terminal pressure-bonding portion and a wire crimp portion, and the connection terminal connected to the power supply connection portion is disposed in the space below.

10. The fuse unit according to claim 1, wherein the power supply connection portion comprises a space above such that the wire installed on the power supply connection portion leads out in an upward direction toward the space above, the connection terminal has a bend that is bent substantially at right angles at a portion between a terminal pressure-bonding portion and a wire crimp portion, the inserted fixing bolt is inserted into the bolt insertion hole of the power supply connection portion from below the wire crimp portion, and the connection terminal connected to the power supply connection portion is disposed in the space above.

11. The fuse unit according to claim 10, wherein the terminal pressure-bonding portion has a long length and is disposed along the exposed surface of the bus bar in the power supply connection portion and the terminal installation recess, and the wire crimp portion of the wire is disposed downward such that the wire also leads out downward from a rear side of the power supply connection portion.

12. The fuse unit according to claim 1, wherein the power supply connection portion comprises a space rearward such that the wire installed on the power supply connection portion leads out in a horizontal direction toward the space rearward, the connection terminal has a straight form such that a terminal pressure-bonding portion and a wire crimp portion are linear, the inserted fixing bolt is inserted into the bolt insertion hole of the power supply connection portion from below the wire crimp portion, and the connection terminal connected to the power supply connection portion is disposed along the exposed surface of the bus bar in the power supply connection portion and the terminal installation recess.

13. The fuse unit according to claim 12, wherein the exposed surface of the bus bar in the power supply connection portion, the terminal installation recess, and the wire crimp portion of the wire are disposed such that the wire leads out in the horizontal direction toward the space rearward, upward toward a space above, or downward toward a space below the power supply connection portion.

14. A fuse unit comprising:

a bus bar having a power supply connection portion, an output connection portion, and a terminal installation recess provided around the power supply connection portion; and an insulating protection portion disposed on an outer surface of the bus bar so that portions of a surface of the bus bar in the power supply connection portion, the output connection portion, and the terminal installation recess are exposed from the insulating protection portion, wherein the power supply connection portion is provided in a portion of the bus bar on one side of a bent portion at which the bus bar is bent, the terminal installation recess is provided to extend to a position of the bent portion of the bus bar, the output connection portion comprises:

a first output connection portion; and second output connection portions, the first output connection portion comprises a bolt press-fit groove; and each of the second output connection portions comprises a bolt screw hole.

15. The fuse unit according to claim 14, wherein each of the bolt press-fit groove and the bolt screw holes comprises an inserted bolt; and each of the respective bolts comprises a head portion that is fixed by the insulting protection portion.

16. A fuse unit comprising:

a bus bar having a power supply connection portion, an output connection portion, and a terminal installation recess provided continuously from the power supply connection portion; and an insulating protection portion disposed on an outer surface of the bus bar so that portions of a surface of the bus bar in the power supply connection portion, the output connection portion, and the terminal installation recess are exposed from the insulating protection portion, wherein the power supply connection portion is provided in a portion of the bus bar on one side of a bent portion at which the bus bar is bent, wherein the terminal installation recess is provided to extend to a position of the bent portion of the bus bar, and wherein a connection terminal is fastened to the power supply connection portion together with a battery terminal.

* * * * *